US009359172B2

(12) United States Patent
Mangini et al.

(10) Patent No.: US 9,359,172 B2
(45) Date of Patent: Jun. 7, 2016

(54) ELEVATOR ROPE SWAY DETECTION AND DAMPING

(75) Inventors: Richard J. Mangini, Brookfield, CT (US); Randall Keith Roberts, Hebron, CT (US)

(73) Assignee: Otis Elevator Company, Farmington, CT (US)

( * ) Notice: Subject to any disclaimer, the term of this patent is extended or adjusted under 35 U.S.C. 154(b) by 469 days.

(21) Appl. No.: 13/810,286

(22) PCT Filed: Jul. 30, 2010

(86) PCT No.: PCT/US2010/043923

§ 371 (c)(1),
(2), (4) Date: Jan. 15, 2013

(87) PCT Pub. No.: WO2012/015429

PCT Pub. Date: Feb. 2, 2012

(65) Prior Publication Data

US 2013/0133983 A1 May 30, 2013

(51) Int. Cl.

| | |
|---|---|
| ***B66B 1/34*** | (2006.01) |
| ***B66B 5/02*** | (2006.01) |
| ***B66B 7/06*** | (2006.01) |

(52) U.S. Cl.

CPC .. *B66B 5/021* (2013.01); *B66B 7/06* (2013.01)

(58) Field of Classification Search

CPC ..... B66B 1/16; B66B 5/02; B66B 5/021; B66B 5/022; B66B 7/10; B66B 7/06

USPC ..... 187/277, 278, 292, 380–388, 391–393, 187/414

See application file for complete search history.

(56) References Cited

U.S. PATENT DOCUMENTS

| | | | | |
|---|---|---|---|---|
| 3,791,490 | A | 2/1974 | Smith | |
| 4,056,169 | A * | 11/1977 | Showalter | 187/278 |
| 4,079,816 | A * | 3/1978 | Ohta | 187/414 |
| 4,106,594 | A | 8/1978 | Kirsch et al. | |
| 4,117,908 | A | 10/1978 | Nara et al. | |
| 4,460,065 | A * | 7/1984 | Saxer | 187/278 |

(Continued)

FOREIGN PATENT DOCUMENTS

| | | |
|---|---|---|
| JP | 09-142756 | 6/1997 |
| JP | 2001316058 | 11/2001 |

(Continued)

OTHER PUBLICATIONS

International Preliminary Report on Patentability for International application No. PCT/US2010/043923 dated Feb. 14, 2013.

(Continued)

*Primary Examiner* — Anthony Salata
(74) *Attorney, Agent, or Firm* — Carlson, Gaskey & Olds

(57) ABSTRACT

An exemplary elevator system includes a first mass that is moveable within a hoistway. A second mass is moveable within the hoistway. A plurality of elongated members couple the first mass to the second mass. At least one damper is positioned to selectively contact at least one of the elongated members if sway occurs. A sensor is associated with the damper. The sensor detects contact between the damper and the at least one of the elongated members. A controller adjusts at least one aspect of elevator system operation responsive to the detected contact.

14 Claims, 2 Drawing Sheets

(56) References Cited

U.S. PATENT DOCUMENTS

| | | | | |
|---|---|---|---|---|
| 4,819,766 | A | 4/1989 | Saito | |
| 5,025,893 | A | 6/1991 | Saito | |
| 5,509,503 | A | 4/1996 | Salmon | |
| 5,861,084 | A * | 1/1999 | Barker et al. | 187/264 |
| 5,947,232 | A * | 9/1999 | Traktovenko et al. | 187/414 |
| 7,793,763 | B2 * | 9/2010 | Zhu et al. | 187/411 |
| 7,905,329 | B2 * | 3/2011 | Urata | 187/384 |
| 8,297,412 | B2 * | 10/2012 | Roberts et al. | 187/388 |
| 9,038,783 | B2 * | 5/2015 | Roberts et al. | 187/412 |
| 2010/0065381 | A1 | 3/2010 | Roberts et al. | |
| 2014/0069747 | A1 * | 3/2014 | Benosman | 187/414 |
| 2014/0229011 | A1 * | 8/2014 | Fukui et al. | 700/275 |
| 2015/0008075 | A1 * | 1/2015 | Benosman | B66B 7/06 187/247 |
| 2015/0027814 | A1 * | 1/2015 | Benosman | B66B 5/02 187/247 |
| 2015/0166304 | A1 * | 6/2015 | Roberts et al. | 187/412 |

FOREIGN PATENT DOCUMENTS

| | | | |
|---|---|---|---|
| JP | 2002003118 | | 1/2002 |
| JP | 2003341954 | A | 12/2003 |
| JP | 2004018174 | | 1/2004 |
| JP | 2004250217 | A | 9/2004 |
| JP | 2007112537 | | 5/2007 |
| JP | 2007119131 | | 5/2007 |
| JP | 2008063112 | | 3/2008 |
| JP | 2008133105 | A | 6/2008 |
| JP | 2009196770 | | 9/2009 |
| JP | 2010070298 | | 4/2010 |
| WO | 2005047724 | A2 | 5/2005 |

OTHER PUBLICATIONS

International Search Report and Written Opinion of the International Searching Authority for International application No. PCT/US2010/043923 dated Mar. 30, 2011.

* cited by examiner

ELEVATOR ROPE SWAY DETECTION AND DAMPING

BACKGROUND

Elevator systems are useful for carrying passengers between various levels in a building, for example. There are various known types of elevator systems. Different design considerations dictate the type of components that are included in an elevator system. For example, elevator systems in high-rise and mid-rise buildings have different requirements than those for buildings that include only a few floors.

One issue that is present in many high-rise and mid-rise buildings is a tendency to experience rope sway under various conditions. Rope sway may occur, for example, during earthquakes or very high wind conditions because the building will move responsive to the earthquake or high winds. As the building moves, long ropes associated with the elevator car and counterweight will tend to sway from side to side. On some occasions rope sway has been produced when there are high vertical air flow rates in the elevator hoistway. Such air flow is associated with the well known "building stack or chimney effect."

Excessive rope sway conditions are undesirable for two main reasons; they can cause damage to the ropes or other equipment in the hoistway and their motion can produce objectionable noise and vibration levels in the elevator cab.

A variety of sway mitigation techniques have been proposed. Most include some type of damper that is positioned to interrupt the side-to-side movement of the ropes at one or more locations in the hoistway. Other proposals include controlling movement of an elevator car during rope sway conditions. For example, U.S. Pat. No. 4,460,065 discloses detecting swaying movement of a compensating rope and limiting movement of the elevator car as a result.

SUMMARY

An exemplary elevator system includes a first mass that is moveable within a hoistway. A second mass is moveable within the hoistway. A plurality of elongated members couple the first mass to the second mass. At least one damper is positioned to selectively contact at least one of the elongated members if sway occurs. A sensor is associated with the damper. The sensor provides an indication of contact between at least one of the elongated members and the damper. A controller adjusts at least one aspect of elevator system operation responsive to the indication provided by the sensor.

An exemplary method of responding to sway in an elevator system, which includes at least one damper to selectively contact at least one elongated member if sway occurs, includes sensing contact between the damper and the elongated member. At least one aspect of elevator system operation is adjusted responsive to the sensed contact.

The various features and advantages of the disclosed examples will become apparent to those skilled in the art from the following detailed description. The drawings that accompany the detailed description can be briefly described as follows.

DETAILED DESCRIPTION

Figure 1:
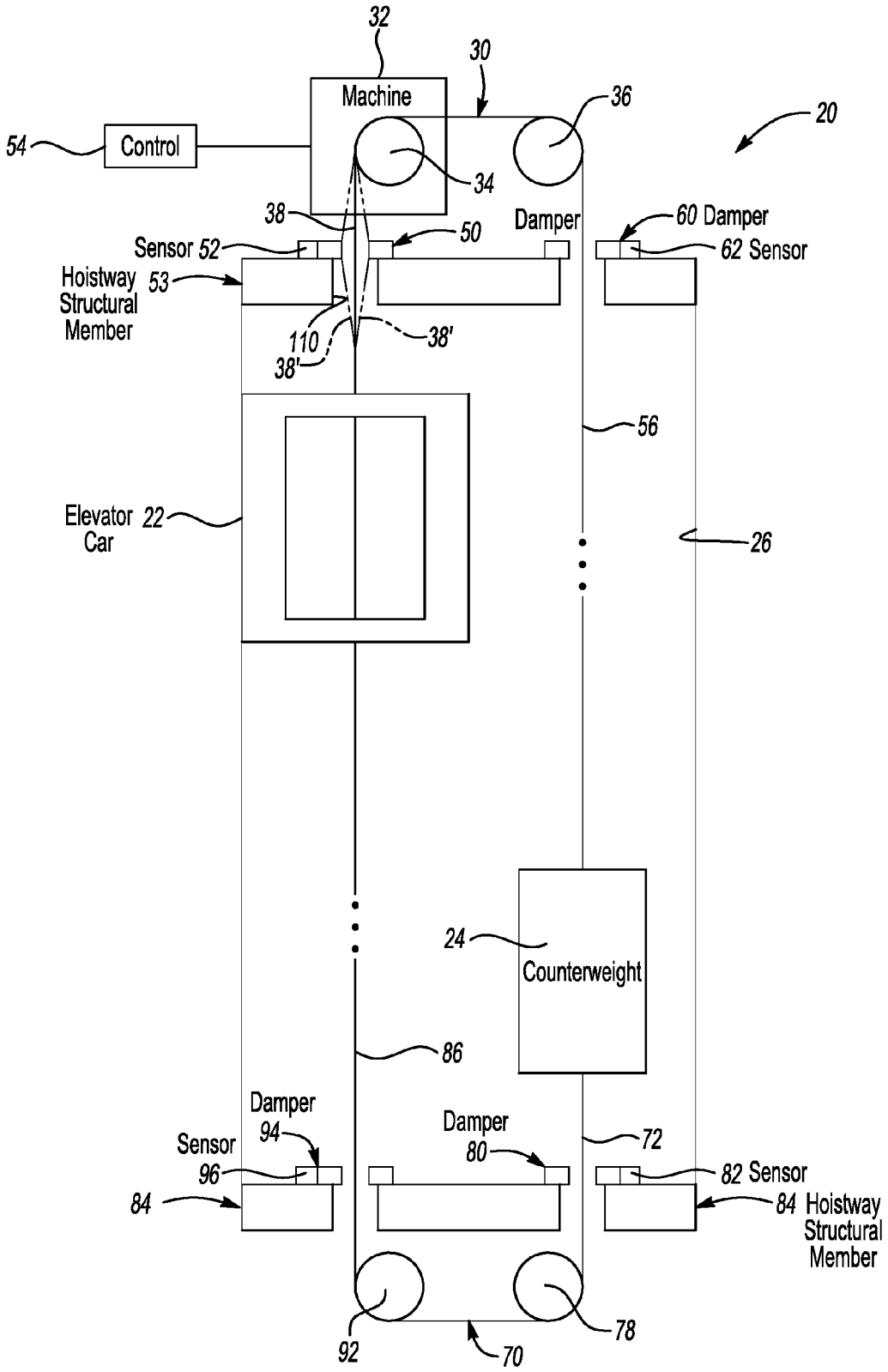
FIG. 1 schematically shows selected portions of an example elevator system.

FIG. 1 schematically shows selected portions of an example elevator system 20. The illustrated example provides a context for discussion purposes. The configuration of the elevator system components may vary from this example in various aspects. For example, the roping configuration, the location of rope sway dampers and the type of dampers may be different. This invention is not necessarily limited to the example elevator system configuration or the specific components of the illustrations.

An elevator car 22 and a counterweight 24 are both moveable within a hoistway 26. A plurality of elongated members 30 (i.e., traction ropes) couple the elevator car 22 to the counterweight 24. In one example, the traction ropes 30 comprise round steel ropes. A variety of roping configurations may be useful in an elevator system that includes features designed according to an embodiment of this invention. For example, the traction ropes may comprise flat belts instead of round ropes.

In the example of FIG. 1, the traction ropes 30 are used for supporting the weight of the elevator car 22 and the counterweight 24 and propelling them in a desired direction within the hoistway 26. An elevator machine 32 includes a traction sheave 34 that rotates and causes movement of the traction ropes 30 to cause the desired movement of the elevator car 22, for example. The example arrangement includes a deflector or idler sheave 36 to guide movement of the traction ropes 30. The illustrated example comprises a single wrap configuration. Other roping arrangements are possible including double wrap traction in which the traction ropes 30 have a return loop around the traction sheave 32 that increases the effective wrap angle on both the traction sheave 32 and the idler sheave 36.

During movement of the elevator car 22 under certain conditions, it is possible that the traction ropes 30 will move laterally (i.e., sway) in an undesirable manner. The traction sheave 34 is intended to cause longitudinal movement of the traction ropes 30 (i.e., along the length of the ropes). Lateral movement (i.e., transverse to the direction of longitudinal movement) is undesired, for example, because it can produce vibrations that reduce the ride quality for passengers within the elevator car 22, can produce objectionable noise, and can lead to elevator rope wear and reduced life. Additionally, the ropes can, under certain circumstances, become entangled with other equipment or structural members in the hoistway.

A portion 38 of the traction ropes 30 between the elevator car 22 and the traction sheave 34 will have a tendency to move laterally under certain elevator operation conditions (e.g., during an elevator run), certain building conditions, certain hoistway conditions or a combination of two or more of these. For example, during an express run of the elevator car 22 from a low floor in the building to one of the highest floors on a windy day when the building is swaying, there may be a tendency for the traction ropes 30 to sway. The portion 38 may move laterally in a manner that causes vibration of the elevator car 22 especially as the swaying rope's length shortens during normal elevator motions. Such lateral movement or sway is schematically shown in a "side-to-side" direction (according to the drawing) in phantom at 38' in FIG. 1. Lateral movement into and out of the page (according to the drawing) is also possible.

The example elevator system 20 includes at least one damper 50 for mitigating the amount of rope sway to minimize the amount of vibration of the elevator car 22. The damper 50 is situated in a fixed position relative to the hoistway 26. In this example, the damper 50 is supported on a structural member 53 of the hoistway 26 such as on a floor associated with a machine room for housing the machine 32. The damper 50 reduces the amount of lateral movement or sway of the portion 38 of the traction ropes 30 by contacting at least some of the traction ropes 30 at the fixed position of the damper if there is sufficient rope sway. The damper absorbs the vibrational energy in the traction ropes 30 so that energy is not translated into vibrations of the elevator car 22, for example.

A sensor 52 is associated with the damper 50. The sensor 52 detects contact between the damper 50 and at least one of the ropes 30. The sensor provides an indication of such contact to an elevator controller 54. Depending on the indication, the elevator controller 54 adjusts at least one aspect of elevator system operation responsive to the sway condition that caused the resulting indication from the sensor 52.

Another portion 56 of the traction ropes 30 exists between the counterweight 24 and the idler sheave 36. It is possible for there to be sway or lateral movement in the portion 56 of the traction ropes 30. The example of FIG. 1 includes a damper 60 in a fixed position relative to the hoistway 26 to reduce the amount of sway in at least the portion 56. The damper 60 has an associated sensor 62 that provides an indication to the elevator controller 54 regarding contact between the damper 60 and at least one traction rope 30.

The illustrated elevator system 20 includes a plurality of compensation ropes 70 (e.g., elongated members such as round ropes). A portion 72 of the compensation ropes 70 exists between the counterweight 24 and a sheave 78 near an opposite end of the hoistway compared to the end of the hoistway where the machine 32 is located. Because the portion 72 of the compensation ropes 70 may move laterally or sway under certain elevator operating conditions, a damper 80 is provided in a fixed position relative to the hoistway 26. The damper 80 in this example is supported on a hoistway structural member 84 such as a portion of the building near a pit in which the sheave 78 is located, for example. The damper 80 has an associated sensor 82 that communicates with the elevator controller 54. The sensor 82 provides an indication of sway of the portion 72 when a compensation rope 70 contacts the damper 80.

Another portion 86 of the compensation ropes 70 is between the elevator car 22 and a sheave 92. In this example, a damper 94 is supported on the structural member 84 of the hoistway 26. The damper 94 has an associated sensor 96 that communicates with the elevator controller 54 like the other example sensors.

Some example elevator systems will include all of the dampers 50, 60, 80, and 94. Other example elevator systems will include only a selected one of the dampers or others in other locations. Still others will include different combinations of a selected plurality of the example dampers. Given this description, those skilled in the art will realize damper locations and configurations to meet their particular needs.

Figure 2:
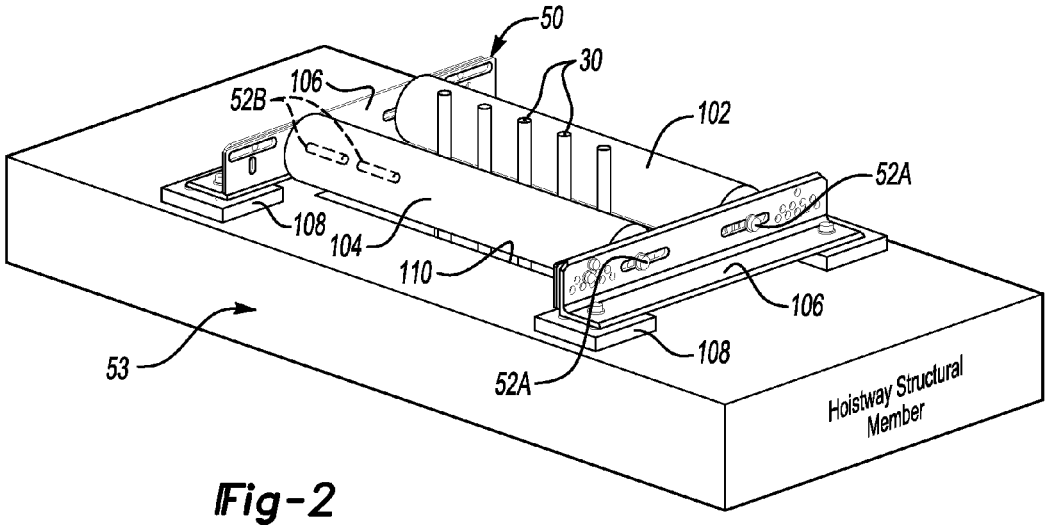
FIG. 2 is a perspective, diagrammatic illustration of an example damper.

FIG. 2 illustrates one example damper 50. The configuration of the dampers 60, 80 and 94 in FIG. 1 can be the same as that shown in FIG. 2, for example. The illustrated damper 50 includes impact members 102 and 104 that are positioned to remain clear of the traction ropes 30 during acceptable elevator operating conditions (e.g., desired longitudinal movement of the ropes without lateral movement). The fixed position of the damper 50 outside of the travel path of the elevator car 22 and the clearance between the ropes and the impact members allows for the damper 50 to remain in a fixed position where the impact members 102 and 104 are ready to mitigate undesired sway of the traction rope 30 at all times. In other words, the damper 50 is passive in nature in that it does not have to be actively deployed or moved into a position where it will perform a sway mitigating function. In another example, a damper is actively deployed or moved into a sway mitigating position under selected conditions. The damper 50 is situated for damping rope sway levels any time that rope sway occurs.

The impact members 104 and 102 in this example comprise bumpers having rounded surfaces configured to minimize any wear on the traction ropes 30 as a result of contact between the traction ropes 30 and the impact members 102 and 104 resulting from lateral movement of the traction ropes 30. The spacing between the impact members 102 and 104 and the traction ropes 30 minimizes any contact between them except for under conditions where an undesired amount of lateral movement of the ropes 30 is occurring.

In the illustrated example, a damper frame 106 supports the impact members 102 and 104 in a desired position to maintain the spacing from the traction ropes 30 under many elevator system conditions. The illustrated example includes mounting pads 108 between the frame 106 and the hoistway structural member 53. The mounting pads 108 reduce any transmission of vibration into the structure 53 as a result of impact between the traction ropes 30 and the impact members 102 and 104, which minimizes the possibility of transmitted noise into the hoistway. In the illustrated example, a spacing between the impact members 102 and 104 is less than a spacing provided in a gap 110 within the floor or structural member 53 through which the traction ropes 30 pass. This closer spacing between the impact members 102 and 104 compared to the size of the gap 110 ensures that the traction ropes 30 will contact the impact members 102 and 104 before having any contact with the structural member 53.

In one example, the impact members 102 and 104 comprise rollers that roll about axes responsive to contact with the moving traction ropes 30 under sway conditions.

In this example, the sensor 52 includes sensor elements 52*a* that detect when an associated impact member 102 or 104 rotates as a result of contact with the moving traction rope 30. Such contact will occur when there is lateral or side-to-side movement of at least one of the traction ropes 30 under sway conditions. One example sensor element 52*a* comprises a potentiometer that provides an analog signal indicating an amount of rotation of the associated impact member. Another example sensor element 52*a* comprises a rotary encoder. The sensor elements 52*a* can also provide information regarding an amount of time during which the impact members 102 and 104 are rotating as a result of contact with the traction rope 30.

The indication regarding the amount of rotation, the amount of time during which rotation is occurring or both can provide information to the elevator controller 54 regarding a severity of the sway condition. For example, relatively minor sway would result in a smaller amount of rotation of an impact member compared to a larger amount of sway or sway that is occurring over a longer period of time. Similarly, the length of time over which the impact members 102 and 104 are rotating is indicative of the amount of sway in the traction rope 30 because continued contact between at least one of the traction ropes 30 and an impact member indicates ongoing sway conditions. The illustrated example, therefore, provides an indication of the amount of sway to the elevator controller 54 so that the elevator controller 54 can respond by altering at least one operating parameter of the elevator system 20 to address the sway condition.

One example includes using the elevator controller 54 to slow down movement of the elevator car 22, limit the length of an elevator run into the upper or lower landings, bring the elevator car 22 to a stop, move the elevator car 22 to a designated location within the hoistway 26 that is considered an advantageous location during sway conditions, cause the elevator car 22 to proceed to a nearest landing and cause the elevator car doors to open to allow passengers to exit the elevator car or a combination of one or more of these, depending on the magnitude of the indication from the sensor 52.

In one example, the impact members 102 and 104 include a resilient material that absorbs some of the energy associated with the lateral movement of the traction ropes 30. Absorbing such energy reduces the amount of sway and elevator car vibration.

This example includes additional sensor elements 52*b* that provide an indication of a force associated with the contact between the impact members 102 and 104 and at least one of the traction ropes 30. For example, a strain gauge or load cell is associated with the impact members for providing an indication of a force incident on the impact members resulting from contact with a traction rope. This indication of force provides additional information to the controller 54 regarding a severity of the sway condition. For example, a larger amount of sway will cause a larger incident force.

The elevator controller 54 in one example is programmed to select how to adjust at least one parameter of the elevator system 20 based upon a severity of the sway condition as indicated by signals from at least one of the sensor elements 52*a* or 52*b*. One example includes preprogramming the elevator controller 54 to select appropriate responsive action based upon predetermined sensor outputs. Given this description, those skilled in the art will realize how to select appropriate elevator control operations responsive to different sway conditions to meet the needs of their particular situation.

In one example, the controller effectively cancels the adjustments that were triggered by detected rope sway or resets system operation to a normal operating condition based on continued monitoring the output from one or more of the sensors 52, 62, 82 and 96. Once the sensor output information indicates that sway conditions have ceased, the elevator system 20 can resume normal operation.

Figure 3:
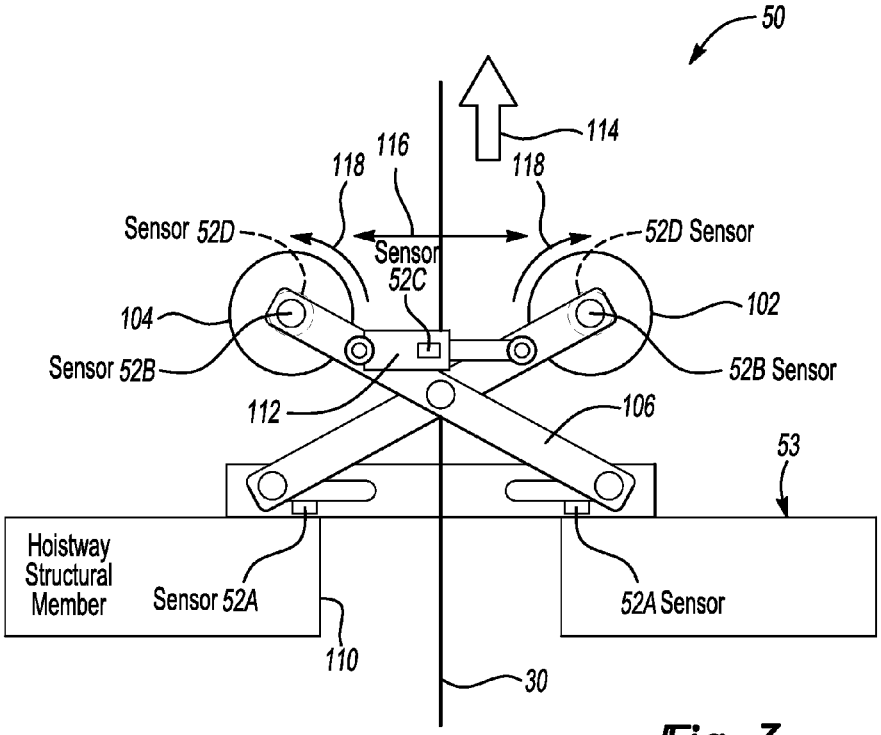
FIG. 3 schematically illustrates another example damper.

FIG. 3 illustrates another example damper configuration in which the impact members 102 and 104 are rollers that rotate responsive to contact with the traction ropes 30 as the ropes are moving longitudinally and laterally. In this example, the frame 106 is configured to allow lateral movement of the impact members 102 and 104 responsive to contact with the traction ropes 30. A biasing member 112 urges the impact members 102 and 104 into a rest position where they maintain a spacing from the traction ropes 30 under most conditions. In one example, the biasing member 112 comprises a mechanical spring, a gas spring or a hydraulic shock absorbing device Impact between the traction ropes 30 and one of the impact members 102, 104 tends to urge that impact member away from the other against the bias of the biasing member 112. This arrangement provides additional energy absorbing characteristics for further reducing the amount of vibrational energy within the rope 30 because energy is expended to overcome the bias of the biasing member 112.

As can be appreciated from the drawing, as the traction rope 30 moves longitudinally as shown by the arrow 114 and laterally as shown by the arrow 116, any contact between the traction ropes 30 and one of the impact members 102 or 104 will cause rotation as schematically shown by the arrows 118 and will tend to urge the impact members away from each other against the bias of the biasing member 112 (e.g., in the direction of the arrow 116).

In this example, sensor elements 52*a* provide an indication of an amount of lateral or side-to-side movement of the impact members 102 and 104. A linear transducer is used in one example for detecting an amount of movement of the impact members 102 and 104 away from each other. Another example includes a proximity switch. The example of FIG. 3 also includes sensor elements 52*b*, such as rotary potentiometers or rotary encoders to provide an indication of an amount of rotation of the impact members 102 and 104 responsive to contact with a traction rope 30.

Another sensor element 52*c* is associated with the biasing member 112. The sensor element 52*c* detects an amount of force associated with contact between a traction rope 30 and the impact members 102 and 104 by detecting a corresponding amount of movement of portions of the biasing member 112. Given information regarding a force associated with the bias of the biasing member 112, an amount of movement of components of the biasing member 112 can be interpreted as the amount of force required to cause such movement. In another example, the sensor element 52*c* directly measures the force associated with overcoming the bias of the biasing member 112.

The example of FIG. 3 also includes sensor elements 52*d* such as load cells or strain gauges that detect a force incident on the impact members 102 and 104 as the result of contact with a traction rope 30.

The various sensor elements 52*a*-52*d* in FIG. 3 may be used individually or in combinations of two or more of such sensor elements. The example of FIG. 3 demonstrates how a variety of different sensors can be incorporated into a damper device to provide feedback information regarding the sway conditions that cause contact between the damper and an elongated member within an elevator system. Example types of sensing include contact, acceleration, number of contacts, and noise, some of which are mentioned in the description above. This feedback information is useful for adjusting an operating parameter of the elevator system 20.

One feature of the disclosed examples is that the indication provided to the elevator controller 54 can be customized to meet the particular needs of a particular embodiment. For example, analog signal feedback can be used to provide amplitude information (e.g., an amount of movement or an amount of force) that is useful for making a determination regarding the severity of a sway condition. This can provide additional useful information compared to a digital arrangement in which only an indication that sway is occurring may be provided. Of course, some implementations of this invention will include digital signal outputs from one or more sensors to achieve a responsive adjustment of elevator system operation to address sway conditions. A combination of analog and digital signals is used in at least one example. The ability to provide information regarding a severity of the sway condition allows for tailoring the response of the elevator controller 54 to the current sway conditions in the hoistway 26.

Any one of the dampers 50, 60, 80 or 94 may have a configuration as shown in FIG. 2 or 3. Of course, other configurations of those dampers are possible and this invention is not necessarily limited to a particular construction of the damper, itself. Similarly, the placement or type of sensor 52 may vary from the disclosed examples to meet the needs of a particular embodiment.

In another example, one or more of the dampers 50, 60, 80 and 94 comprises a rope guard that is supported on the corresponding structure 53 or 84 to guard against damage to the ropes 30, 70, the hoistway structure or both. An appropriate one of the disclosed example sensors is associated with the rope guard damper to provide an indication of contact between the damper and the rope as described above. In some examples, such rope guard dampers comprise sheet metal and the sensor is associated with the sheet metal in a manner that the sensor detects at least one of impact vibrations, forces or radiated noise.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a first mass that is moveable within a hoistway;

a second mass that is moveable within the hoistway;

a plurality of elongated members coupling the first mass to the second mass;

at least one damper that selectively contacts at least one of the elongated members responsive to lateral movement of the at least one of the elongated members;

a sensor that detects contact between the damper and the at least one of the elongated members, wherein the sensor provides an indication of at least one feature of the detected contact between the damper and the at least one of the elongated members, the indication of at least one feature comprising at least one of:

(i) an indication of a force incident on the damper resulting from contact with the at least one of the elongated members, (ii) an indication of noise associated with contact between the damper and the at least one of the elongated members.

(iii) a length of time during which the contact is detected, and (iv) a number of times that the detected contact occurs; and a controller that controls at least one aspect of elevator system operation responsive to the detected contact, wherein the controller selects the at least one aspect of elevator system operation for adjustment based upon the magnitude of the indication from the sensor, the at least one aspect including at least one of limiting a length of an elevator run, moving the elevator car to a designated location within the hoistway that is considered an advantageous location during sway conditions, and causing the elevator car proceed to a selected position and causing the elevator car doors to open.

2. An elevator system, comprising:

a first mass that is moveable within a hoistway;

a second mass that is moveable within the hoistway:

a plurality of elongated members coupling the first mass to the second mass;

at least one damper that selectively contacts at least one of the elongated members responsive to lateral movement of the at least one of the elongated members;

a sensor that detects contact between the damper and the at least one of the elongated members, wherein the sensor provides an indication of at least one feature of the detected contact between the damper and the at least one of the elongated members;

a controller that controls at least one aspect of elevator system operation responsive to the detected contact, wherein the controller selects the at least one aspect of elevator system operation for adjustment based upon the magnitude of the indication from the sensor, the at least one aspect including at least one of limiting a length of an elevator run, moving the elevator car to a designated location within the hoistway that is considered an advantageous location during sway conditions, causing the elevator car proceed to a selected position and causing the elevator car doors to open, wherein the sensor provides an indication of movement of the at least one damper resulting from contact with the at least one of the elongated members.

3. The elevator system of claim 2, wherein the sensor provides an indication of rotational movement of the damper.

4. The elevator system of claim 2, wherein the sensor provides an indication of lateral movement of the damper.

5. The elevator system of claim 2, wherein the sensor provides an indication of acceleration of the at least one damper.

6. The elevator system of claim 2, wherein the sensor detects a force incident on the damper resulting from contact with the at least one of the elongated members, the sensor providing an output that is an indication of the detected force.

7. The elevator system of claim 2, wherein the sensor detects noise associated with contact between the damper and the at least one of the elongated members.

8. The elevator system of claim 2, wherein the at least one feature comprises at least one of a length of time during which the contact is detected, a force incident on the damper resulting from the contact or a number of times that the detected contact occurs.

9. The elevator system of claim 1, wherein the damper comprises a rope sway mitigation damper supported at a selected position in the hoistway where the damper is useful for reducing sway of the elongated members.

10. A method of responding to sway in an elevator system, which includes at least one damper configured to selectively contact at least one elongated member if sway occurs, comprising the steps of:

sensing contact between the damper and the elongated member including at least one of (i) sensing a force incident on the damper resulting from contact with the elongated member, (ii) sensing noise associated with contact between the damper and the elongated member, and (iii) sensing movement of the damper resulting from contact with the elongated member;

providing an indication of the sensed contact;

adjusting at least one aspect of elevator system operation based upon a magnitude of the indication, the at least one aspect including at least one of limiting a length of an elevator run, moving the elevator car to a designated location within the hoistway that is considered an advantageous location during sway conditions, and causing the elevator car proceed to a selected position and causing the elevator car doors to open.

11. The method of claim 10, comprising sensing lateral movement of the damper resulting from contact with the at least one elongated member.

12. The method of claim 10, comprising sensing rotational movement of the damper resulting from contact with the elongated member.

13. The method of claim 10, comprising sensing acceleration of the damper resulting from contact with the elongated member.

14. The method of claim 10, comprising providing an indication of at least one of a length of time during which the contact is detected, a force incident on the damper resulting from the contact or a number of times that the detected contact occurs.

* * * * *